United States Patent [19]

Kruyer

[11] 4,392,949

[45] Jul. 12, 1983

[54] CONDITIONING DRUM FOR SLURRIES AND EMULSIONS

[76] Inventor: Jan Kruyer, 4643-82 Ave., Edmonton, Alberta, Canada, T6B 2L9

[21] Appl. No.: 178,001

[22] Filed: Aug. 14, 1980

[30] Foreign Application Priority Data

Aug. 15, 1979 [CA] Canada ..... 333831

[51] Int. Cl.[3] ..... B03B 1/00; B03B 5/56; B03D 3/06; C10G 1/04

[52] U.S. Cl. ..... 209/5; 208/11 LE; 209/11; 209/49; 210/403; 210/404

[58] Field of Search ..... 209/5, 45, 46, 47, 49; 210/403, 404; 264/117; 208/11 R, 11 LE; 196/46

[56] References Cited

U.S. PATENT DOCUMENTS

| | | | |
|---|---|---|---|
| 968,206 | 8/1910 | Strom | 209/47 X |
| 1,520,752 | 12/1924 | Horwitz | 208/11 LE |
| 1,771,684 | 7/1930 | Miller | 196/46 |
| 1,992,133 | 2/1935 | Tarte | 196/46 |
| 2,321,243 | 6/1943 | Range | 210/403 X |
| 2,831,210 | 4/1958 | DeVaney | 425/222 X |
| 2,903,407 | 9/1959 | Fischer | 208/11 LE |
| 2,957,818 | 10/1960 | Fischer | 209/5 |
| 3,296,117 | 6/1967 | Ross | 208/11 LE |
| 3,401,110 | 9/1968 | Floyd | 209/5 X |
| 3,460,195 | 8/1969 | Erickson | 264/117 X |
| 3,471,014 | 10/1969 | Fuchs | 209/482 X |
| 3,998,202 | 12/1976 | Didion | 209/297 X |
| 4,033,729 | 7/1977 | Capes | 44/1 A |
| 4,057,486 | 11/1977 | Meadus | 208/11 LE |
| 4,200,517 | 4/1980 | Chalmers | 208/11 R |
| 4,250,017 | 2/1981 | Reale | 208/11 LE |

FOREIGN PATENT DOCUMENTS

| | | | |
|---|---|---|---|
| 638886 | 3/1962 | Canada | 208/11 LE |
| 787898 | 6/1968 | Canada | 208/11 LE |
| 560226 | 3/1944 | United Kingdom | 209/49 |

*Primary Examiner*—Kathleen J. Prunner
*Attorney, Agent, or Firm*—Thorpe, North & Western

[57] ABSTRACT

Oil sand feedstock is mixed in a tumbler with steam and water in the presence of inwardly extending oleophilic surface, that are attached to the drum interior, for the purpose of enhancing oil particle size thereby producing an oil sand slurry suitable for subsequent separation. Undigested oil sand, oversize rocks and debris may be removed prior to said separation.

31 Claims, 6 Drawing Figures

CONDITIONING DRUM FOR SLURRIES AND EMULSIONS

BACKGROUND OF THE INVENTION

The present invention relates to a method for preparing an oil sand slurry particularly containing enlarged oil particles suited for subsequent separation of said slurry by means of an apertured oleophilic belt or other separation apparatus. The present invention also relates to a method for increasing oil particle size of an oil-in-water emulsion for improving subsequent separation of said emulsion.

This invention is primarily concerned with recovering bitumen from mined oil sand and for recovering bitumen or oil phase from oil and water mixtures produced by enhanced recovery from oil wells and from partial combustion of solid or liquid hydrocarbons. Extensive deposits of oil sands, which are also known as tar sands and bituminous sands, are found in Northern Alberta, Canada. The sands are composed of siliceous material with grains generally having a size greater than that passing a 325 mesh screen (44 microns) and a relatively heavy, viscous petroleum, called bitumen, which fills the voids between the grains in quantities of from about 5 to 21 percent of total composition. (All percentages referred to herein are in weight percent unless noted otherwise.) Generally the bitumen content of the sand is between about 5 and 15 percent. This bitumen contains typically about 4.5 percent sulfur and 38 percent aromatics. Its specific gravity at 60° F. ranges generally from about 1.00 to about 1.06. The oil sands also contain clay and silt. Silt is defined as siliceous material which will pass a 325 mesh screen, but which is larger than 2 microns. Clay is material smaller than 2 microns, including some siliceous material of that size. Extensive oil sands deposits are also found elsewhere in the world, such as in the Orinoco heavy oil belt of Venezuela and in the area near Vernal, Utah in the United States. The mineral and bitumen of these deposits differ somewhat from those of the Alberta deposits. Compared with the Alberta oil sands, the Utah deposit contains a coarser sand, less clay and an even more viscous bitumen.

Much of the world resource of bitumen and heavy oil is deeply buried by overburden. For example it has been estimated that only about 10 percent of the Alberta oil sand deposit is close enough to the earth's surface to be conveniently recovered by mining. The remainder is buried too deeply to be economically surface mined. Hydraulic mining or tunnel mining has been proposed for these deeper deposits. Generally, however, it is considered that enhanced recovery by steam injection, by injection of aqueous solutions, and/or by in-situ combustion may possibly be more effective for obtaining bitumen or heavy oil from deeply buried formations. Such enhanced recovery methods use one or more oil wells that penetrate the formation and stimulate or recover the resource. Recovery of bitumen from a well by steam stimulation is described for example, in Canadian Pat. No. 822,985 granted on Sept. 16, 1969 to Fred D. Muggee. Depending upon the procedure employed, enhanced recovery methods either produce mixtures of oil, water and water-in-oil emulsions or produce oil-in-water emulsions.

There are several well known procedures for separating bitumen from mined oil sands. In a hot water method, such as disclosed for example in Canadian Pat. No. 841,581 issued May 12, 1970 to Paul H. Floyd et. al.; the bituminous sands are jetted with steam and mulled with a minor amount of hot water and sodium hydroxide in a conditioning drum to produce a pulp which passes from the conditioning drum through a screen, which removes debris, rocks and oversize lumps, to a sump where it is diluted with additional water. It is hereafter carried into a separation cell.

In the separation cell, sand settles to the bottom as tailings which are discarded. Bitumen rises to the top of the cell in the form of a bituminous froth which is called the primary froth product. An aqueous middlings layer containing some mineral and bitumen is formed between these layers. A scavenging step is normally conducted on this middlings layer in a separate flotation zone. In this scavenging step the middlings are aerated so as to produce a scavenger tailings product which is discarded and a scavenger froth product. The scavenger froth product is thereafter treated to remove some of its high water and mineral matter content and is thereafter combined with the primary froth product for further treatment. This combined froth product typically contains about 52 percent bitumen, 6 percent mineral, 41 percent water, all by weight, and may contain from 20 to 70 volume percent air. It resembles a liquid foam that is difficult to pump and, for that reason, is usually treated with steam to improve its flow characteristics.

The high water and mineral contents of the combined froth product normally are reduced by diluting it with a hydrocarbon diluent such as naptha. it is then centrifuged to produce a tailings product and a final bitumen product that typically contains essentially no water and about 1.3 percent solids and that is suitable for coking, hydrovisbreaking and other refining techniques for producing a synthetic crude oil. The tailings products, containing some naptha, are discarded.

There are basically four effluent streams from the Hot Water Process. Each carries with it some of the bitumen of the feed; thereby reducing the efficiency of the Process. These include the oversize material, the sand from the separation cells, the silt and clay from the scavenger cells and the tailings from the centrifuges. Up to 10 percent of the bitumen in the original feed and up to 2½ percent of the naptha stream may be lost in this manner. Much of this bitumen effluent finds its way into large retention ponds that are typical of the Hot Water Process. The bottom of one such retention pond may contain up to 50 percent dispersed mineral matter substantially of clay and silt as well as about 5 percent bitumen. As disclosed in Canadian Pat. No. 975,697 issued on Oct. 7, 1975 to Davitt H. James, this part of the pond contents, referred to as sludge, is a potential source of bitumen.

The Hot Water Process described in the preceeding paragraphs separates bitumen from a prepared oil sand slurry. Various methods for preparing oil sand slurries are taught in the prior art, as for example disclosed in Canadian Pat. No. 918,588 issued on Jan. 9, 1973 to Marshall R. Smith et al. and in U.S. Pat. No. 3,968,572 issued on July 13, 1976 to Frederick C. Stuchberry. These apparatus as disclosed were especially designed to form a slurry that is hot, that contains finely dispersed air bubbles and wherein the bitumen is in the form of small flecks. Such a slurry is amenable to subsequent separation in a hot water bath, after dilution, wherein bitumen forms into a froth that rises to the top of the bath and is skimmed therefrom. Alkaline reagents such as sodium hydroxide are normally added in this Process to give to the slurry those properties that provide for efficient flotation of the bitumen in said water bath. However, in the presence of sodium hydroxide, fine clay particles in the effluent streams from this Process do not settle readily. For this reason inordinately large settling ponds are required to contain the effluents from commercial hot water oil sands extraction plants.

The present invention applies to a process for preparing a bitumen slurry which can be processed without using the bitumen flotation mechanism of the prior art, but that uses apertured oleophilic endless conveyor belts to achieve slurry separations. These oleophilic belt separation processes are superior to the Hot Water Process because separations are conducted at lower process temperatures and with lower water requirements. For comparable oil sand feedstocks, the bitumen produced by enlarging the size of dispersed bitumen phase particles followed by oil phase aqueous phase separations with an apertured oleophilic belt as typically disclosed is of higher quality than the froth produced by a Hot Water Process.

The apertured oleophilic conveyor belt, that may be used to separate emulsions, slurries, or mixtures of oil phase and aqueous phase, typically consists of a mesh belt that is woven from fibre, string or wire of high tensile strength and fatigue resistance that is oleophilic by nature or that will bond strongly with a belt coating that is oleophilic. This belt typically supported by two conveyor end rolls that provide tension and form to the belt. Separation is achieved by passing a slurry, emulsion or mixture of oil phase and water phase, with or without particulate solids, through the belt one or more times. Water phase and particulate solids in the water phase pass through the belt apertures and are discarded while oil phase attaches itself to the belt because of its attraction for the oleophilic belt surfaces. The oil phase subsequently is recovered from said belt as a product. Typical processes are disclosed and claimed in the inventor's copending applications Ser. No. 37,896 filed May 10, 1979 and Ser. No. 37,897 filed May 10, 1979 and now issued as U.S. Pat. Nos. 4,224,138 and 4,236,995 respectively.

BRIEF DESCRIPTION OF THE INVENTION

In accordance with the broadest concepts of the present invention oil sand is conditioned in a tumbler having inwardly extending protrusions to prepare a suitable mixture of bitumen and aqueous phase having enlarged bitumen particles for separation by an oleophilic apertured endless conveyor belt, such that the aqueous phase effectively passes through the belt apertures and is discarded while an optimum amount of the bitumen is captured by the oleophilic surfaces of the belt and is removed from the belt surface for subsequent refining.

In the preferred embodiment, oil sand is conditioned with water and steam in a rotating tumbler or drum, that is provided with apertured oleophilic baffles mounted longitudinally along the tumbler inner wall to produce a slurry by the combined action of tumbling and heating in the presence of water, steam and oleophilic tumbler surfaces. Oversize particles such as rocks, lumps of clay, debris and undigested oil sand are removed by means of a screen and the slurry is then transferred to an apertured oleophilic endless conveyor belt or other suitable apparatus for separation.

In a second embodiment the rotating tumbler is provided with a multiplicity of oleophilic protrusions other than baffles that protrude from the inside drum wall into the drum interior.

In a third embodiment the tumbler is provided with an internal cylindrical screen that prevents oversize material from contacting the oleophilic protrusions.

In a fourth embodiment the coarse solids content of the slurry product of the drum is reduced prior to separation by an apertured oleophilic belt separator.

PRIOR ART

In searching the patent literature the prior art that appears to be closest to the present invention is an oil agglomeration process disclosed in Canadian Patent 787,898 issued on June 18, 1968 to Ira A. Puddington et. al. In that process, a mixture of oil phase and hydrophilic solids in an aqueous phase is subjected to cocurrent milling, kneading and agitation until the oil phase separates and is recovered as discrete agglomerates when the milling surfaces are hydrophilic or is recovered as an adherent layer when at least part of the milling surfaces are oleophilic. The major differences between the present invention and that prior art are:

1. The prior art requires cocurrent milling, kneading and agitation, whereas the present invention only requires tumbling in a horizontal rotating drum.
2. The prior art uses hydrophilic milling surfaces to permit recovery of discrete semi-solid oil phase agglomerates. The present invention uses oleophilic drum surfaces to increase the size of oil phase particles.
3. The prior art uses oleophilic milling surfaces to recover an adherent layer of oil phase therefrom whereas the present invention is not based upon oil phase recovery from milling surfaces but permits oil phase to accumulate on oleophilic drum surfaces and projections and encourages subsequent flowing or dripping therefrom.

DRAWINGS

OBJECTS

Figure 1:
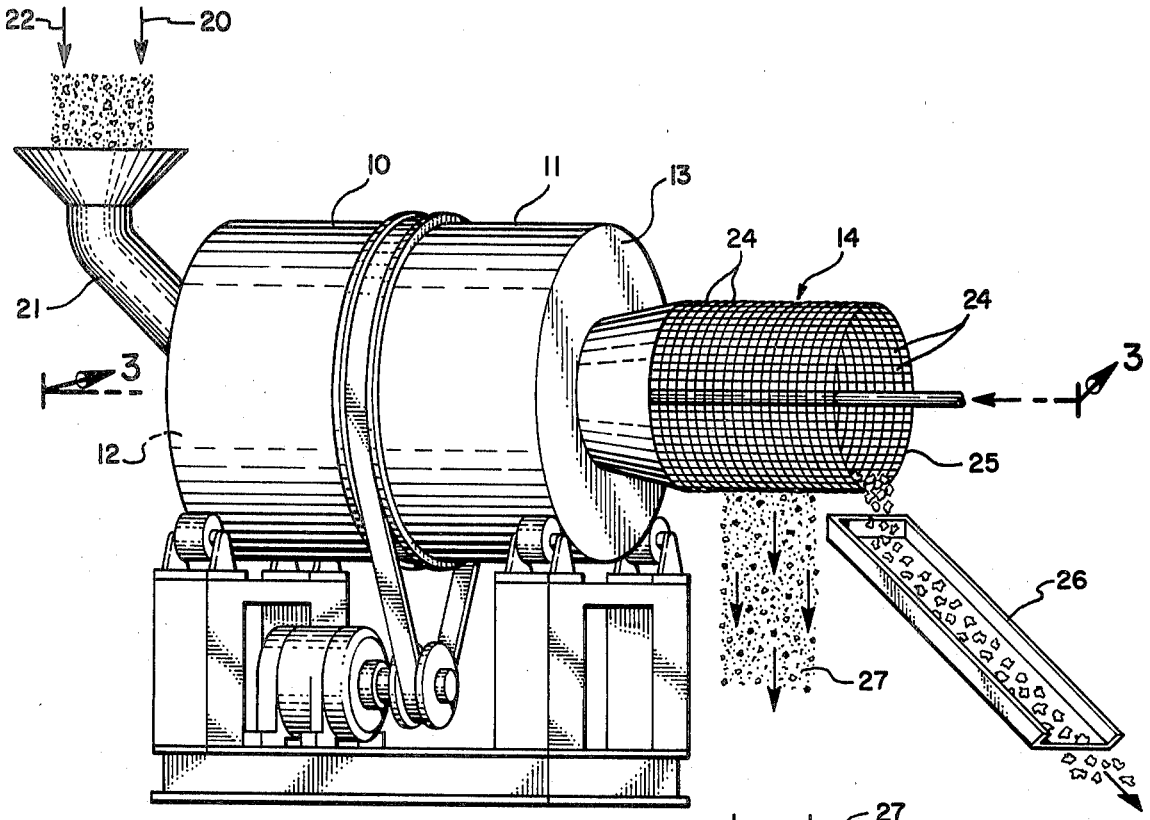
FIG. 1 is a perspective view showing a horizontal drum as used in the present invention to produce a slurry.

An object of the present invention is to prepare a slurry of oil phase and aqueous phase wherein the phases can be separated by a process that does not necessarily rely upon the prior art principle of oil phase flotation.

A further object of the present invention is to process various bitumen reduced streams or effluents from commercial hot water oil sands extraction plants in such a manner that subsequent bitumen recovery therefrom will be enhanced.

A yet further object of the present invention is to condition oil-water mixtures or emulsions that are produced from an oil well when enhanced recovery techniques are used in such a manner that subsequent oil phase recovery from the oil-water mixture or emulsions will be improved.

A primary object of the present invention is to prepare a smooth slurry by tumbling oil sand with steam and water in a rotating drum in such a way as to optimize subsequent oil separation therefrom by an apertured oleophilic belt or other appropriate means.

These objects of the present invention are accomplished by tumbling a slurry, emulsion, or oil-in-water mixture in a rotating drum in the presence of projecting oleophilic surfaces, that are part of the drum interior, according to the following detailed description.

DETAILED DESCRIPTION OF THE INVENTION

As used in the present invention "water-in-oil emulsion", "oil phase" and "bitumen" all refer to petroleum oil that may contain water droplets and particulate solids. "Bitumen froth" refers to bitumen that contains water phase and solids, and significant quantities of entrained gas. "Oil-in-water emulsion" refers to a stable mixture of small oil phase droplets dispersed in a continuous water phase and may contain up to about 5 percent particulate solids. "Slurry" refers to a mixture containing continuous water phase, dispersed oil phase and more than about 5 percent particulate solids. "Aqueous phase" refers to any type of continuous water phase; it may contain particulate solids, oil particles and/or chemicals and it generally is used to describe a slurry or emulsion that has passed or is to be passed through an apertured oleophilic belt. "Dispersed phase" refers to that phase in the mixture, emulsion or slurry that is not continuous.

It is to be understood that the present invention is to separate bitumen, heavy oil or light oil from particulate solids and/or water no matter from where they originate. For example, Canadian Pat. No. 726,683 issued on Jan. 25, 1966 to Albert F. Lenhart discloses that oils derived from solid carbonaceous materials, such as from oil shales, coals, and the like, usually are recovered in the form of oil-water emulsions when in-situ combustion is practiced to convert these solid carbonaceous materials to oils. That some patent also discloses that in the recovery of conventional crude oil from wells, oil-water emulsions are produced as well on many occasions. A paper by L. A. Johnson et. al. of the United States Department of Energy, presented at the 13th Intersociety Energy Conversion Engineering Conference in San Diego, Calif. on Aug. 20–25, 1978 discloses that oil-water emulsions, containing particulate solids, usually are produced when oil is recovered by in-situ combustion of tar sands.

The present invention produces a bitumen containing aqueous slurry feed for separation by a process that makes use of an oleophilic apertured belt to capture bitumen particles, droplets and streamers from the aqueous slurry or mixture while permitting the aqueous phase to pass through the apertures. The probability of bitumen adhering to this belt in quantity generally increases with the size of bitumen particles in the mixture. For this reason the methods employed in the present invention to prepare a slurry or mixture for separation also enlarge bitumen particle size and therefore have a significant impact upon the effectiveness of separation.

Figures 3, 4, 5, 6:
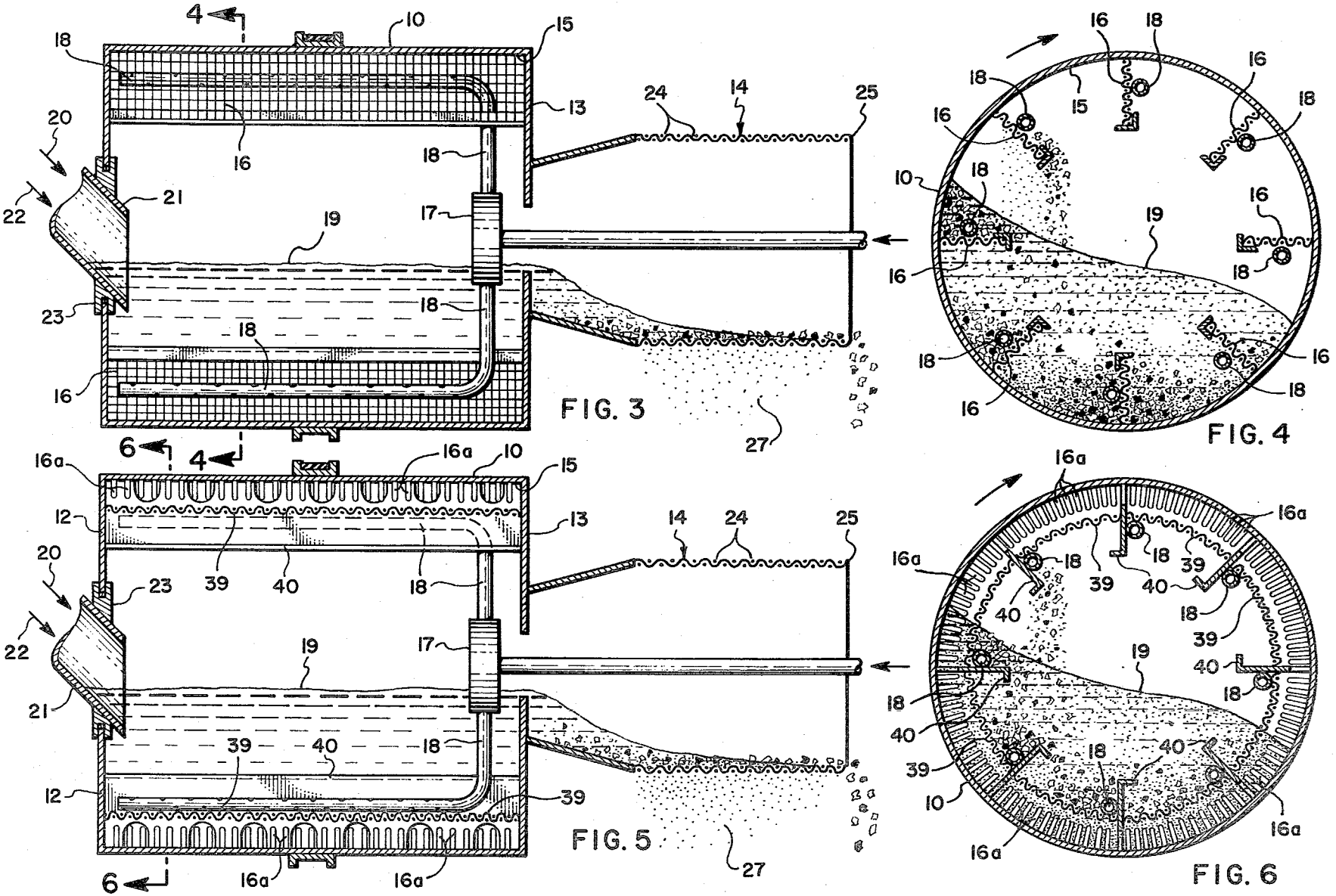
FIG. 3 is a cross sectional view of the preferred form of the drum of FIG. 1 taken along lines 3—3 of FIG. 1.
FIG. 4 is a cross sectional view of the preferred form of the drum of FIG. 1 taken along lines 4—4 of FIG. 3.
FIG. 5 is a cross sectional view of another form of the drum of FIG. 1 taken along the lines 3—3 of FIG. 1.
FIG. 6 is a cross sectional view of another form of the drum of FIG. 1 taken along the lines 6—6 of FIG. 5.

FIGS. 1, 3 and 4, illustrate a conditioning drum for preparing an oil sand slurry that is particularly suited to subsequent separation by an apertured oleophilic belt. This drum 10 is provided with oleophilic protrusions 16 that are mounted on the drum inside wall 15 or walls and that protrude into the drum's interior. These oleophilic protrusion surfaces 16 inside of the rotating drum 10 have the effect of increasing the particle size of the bitumen in the drum mixture 19. For comparable oil sand feedstocks, a slurry produced by a drum without oleophilic protrusions 16 generally has an average bitumen particle size that is smaller that the average particle size of a slurry produced in the same drum but with oleophilic protrusions 16 mounted on an inside drum wall 15 or walls. The inner drum wall 15 or walls, also may be made oleophilic to similarly effect particle size growth of dispersed phase.

Bitumen depleted slurries or emulsions of bitumen in water may be treated as well in the drum of FIG. 1 to increase oil phase particle size in preparation for effective separation of these slurries or emulsions.

In the first step of the preferred process of the present invention oil sand, water and steam are introduced onto a conditioning drum 10 in amounts such that a slurry is produced containing enough water to give it a fluid consistency so that it will mix inside the conditioning drum at the desired temperature of conditioning. Due to the variability of the oil sand feed stocks found in various locations, the actual amount of water required to achieve this may vary somewhat. The desired temperature in the conditioning drum 10 varies somewhat also and is dictated to a degree by concerns of economics and bitumen viscosity. Temperatures generally range from about 110° F. to 180° F. For example at 180° F. the oil sand will break up into a slurry much faster than at 110° F. But the resulting slurry may need to be cooled prior to separation. The thermal energy cost for the process will be greater when the slurry is produced in the drum at this higher temperature and this will need to be balanced against the extra cost of a larger drum, needed when slurry is conditioned at the lower temperature, in order to provide the same rate of slurry production in each case. In general the slurry temperature should be such that the viscosity of the dispersed bitumen or oil phase is greater than 1.0 poise but not greater than 5000 poises. This temperature range will vary with the type of oil phase in the slurry. Slurry temperatures outside this range generally reduce the effectiveness of the oleophilic surfaces and protrusions in the drum for increasing oil phase particle size. A slurry with 25 percent water content by weight, produced at 160° F., is acceptable for many of the Alberta oil sands feedstocks.

Optimum conditions for various feedstocks may be readily determined by those skilled in the art.

With reference to the FIGS. 1, 3 and 4 the drum 10 is a horizontal rotating cylinder having a circular sidewall 11 which is partly enclosed at each end by a washer shaped endwall 12 and 13. A cylindrical apertured screen 14 is mounted on the front endwall 13. The inside drum wall 15 may be oleophilic and oleophilic apertured baffles 16 are mounted lengthwise along this wall 15. Means as illustrated are provided to support and rotate the drum.

Steam is introduced into the drum 10 through a distributor valve 17, which feeds it to a series of perforated pipes 18. These pipes 18 extend longitudinally along the interior surface of the drum in spaced relationship about its circumference. The valve 17 feeds the steam to the pipes 18 when they are submerged within the slurry 19. The oil sand 20 is fed into the rear end of the drum 10 by way of a channel 21. Water 22 is added to the oil sand at the rear end of the drum, also through channel 21, that attaches to the drum by means of a rotary seal 23. The ingredients mix in the drum and form a smooth slurry 19. This slurry then spills over the lip of the front washer 13 and drops through the apertures 24 of the screen 14 to separation means. Rocks and other oversize material leave through the front end 25 of the screen 14 and drop into chute 26 which conveys them to a discard area or other means for removing oversize material may be used. If desired, oversized materials and course sand may be removed prior to the introduction of oil sand 20 and water 22 into the drum by way of Channel 21.

The drum illustrated in FIG. 1 shows the feed and the water inlets at the rear of the drum, and the steam inlet and the slurry product outlet at the front of the drum. However, this is not intended to convey that these are unalterable. For example, it may in some cases be more convenient to have a feed conveyor or pipe that enters the drum at the same end as the slurry exit to permit bringing in the steam at the opposite end. Means for removing oversize material may form part of the drum apparatus or may be in the form of a separate apparatus.

In the drum 10, the oil sand is mixed with steam, heated and formed into a slurry in which the water is in intimate contact with each sand grain and the bitumen particles unite and form into globules or streamers which are larger in size than the bitumen particles initially fed into the drum. In some cases, hot water may be used instead of steam. Or, in the alternative, the drum may be heated externally. The mode of heating will be determined by the nature of the tar sand being treated.

Without in any way attempting to limit the scope of this invention it is believed that the oil phase particle size growth that takes place when a mixture of continuous aqueous phase and dispersed oil phase is tumbled in a drum in the presence of inwardly protruding oleophilic surfaces may be explained as a mechanism of oil coat building and shedding. In this mechanism, dispersed oil phase particles of the mixture in the drum come in contact with any oleophilic surface in the drum, adhere thereto, unite on the surface with other oil phase particles and form into a coat that continues to grow in thickness until the forces of self adhesion in the oil phase coat cannot resist the forces of erosion on the coat surface caused by the movement of mixture past this coat. At that instant the coat begins to shed oil phase particles which on the average are larger than the oil phase particles originally present in the mixture fed to the drum. The force of erosion varies with location in the drum contents and since the drum contents are mixing in the drum, therefore the force of erosion near each oleophilic drum surface varies with time, thus permitting a cyclic accumulation of oil phase on oleophilic drum surfaces and a cyclic shedding of accumulated oil phase therefrom but in most cases retaining a film of oil phase thereon. At least over some temperature range the shed oil phase particles appear to increase in size with an increase in oil phase viscosity.

Oleophilic protrusions 16 mounted inside a drum such as of FIG. 1 are used in the present invention to increase particle size of dispersed oil phase so that subsequent separation of the phases of the drum product is facilitated. The protrusions of FIGS. 3 and 4 are in the form of apertured oleophilic baffles 16 mounted longitudinally on the inside cylindrical drum wall 15 in spaced relationship along its periphery and may also be mounted to the drum endwalls 12 and 13. The baffles 16 may be made from perforated metal, expanded metal or from metal wire that is woven in mesh form and the metal may be chosen such as to be oleophilic under the conditions existing inside the drum or may be molded from oleophilic materials. Alternately, baffles made from metal may be coated with an abrasion resistant highly oleophilic material that bonds strongly to the metal of the baffles.

The baffles 16 of FIGS. 3 and 4 are oleophilic protrusions on inside wall 15 or walls of the rotating drum 10 that permit some slurry 19 flow approximately parallel with the inside cylindrical wall 15 of the drum but that cause rocks and lumps to be tumbled in the drum 10. Other types of protrusions **16*a* mounted on the drum interior 15 are illustrated in FIGS. 5 and 6. These may be in the form of rigid or flexible rods or sprouts or may be deltaic, dendritic, bipinatifid or bladed form, or of any other form that presents a large readily available oleophilic surface area to dispersed oil phase of the mixture in the drum 10. Complex shapes such as these may be molded and attached to a backing, or may be molded in the form of sheets, that may then be mounted to an inside wall 15 of the drum. An apertured metal cylinder 39 may be mounted inside said drum to keep rocks and lumps separate from the oleophilic protrusions 16 and 16*a*. This cylinder 39 may be made from perforated metal, expanded metal or from wire mesh such that it will permit optimum flow of undersize material through its apertures but strong enough to withstand the abrasive action of the oversize material. Aperture size in said apertured cylinder 39 may be dependent upon the type of oleophilic protrusions used, but may be as small as 0.5 inch or smaller. Larger aperture sizes may be used as well. Mixing ribs 40 may be attached to the inner drum wall 15** to facilitate mixing. These ribs may or may not be oleophilic and may or may not be apertured.

For commercial operation the drum 10 diameter may be as small as 5 feet or as large as 100 feet and its length may be as small as 10 feet or as large as 200 feet. The drum may be rotated at any rate of rotation that is most effective for the mixture being prepared, from very slow up to but not exceeding the critical rate. The critical rate of rotation is passed when at the inside drum surface of centrifugal force exceeds the force of gravity. It is defined in revolutions per minute as:

$$\text{Critical rotation rate} = \sqrt{\frac{2936}{r}}$$

where r is the drum inner radius in feet. Above this critical rate, drum contents commences to attach itself to the drum wall and does not readily mix with the remainder of the drum contents. The height of the oleophilic protrusions 16 or **16*a* in the drum may range from 0.003 to 0.3 drum diameters. Any number of protrusions may be mounted on interior wall 15** or walls of the drum consistent with realistic construction and engineering practice and consistent with the need to optimize production of a slurry with a smooth aqueous phase that will readily pass through apertures of an oleophilic apertured belt and with maximum sized dispersed oil phase particles that will readily be captured by oleophilic surfaces of said belt.

The oleophilic protrusions 16 or 16*a* may be made from steel, which may be oleophilic when the mixture in the drum is of neutral pH or lower, but such steel protrusions preferably are coated with a strongly oleophilic material such as neoprene, urethane, polypropylene or any other such plastics or aritifical rubbers. Any coating that adheres strongly to the protrusions, that is erosion and abrasion resistant, and that is strongly oleophilic may be used. Alternately the protrusions may be molded or fabricated from these same materials.

The baffles or sheets of oleophilic protrusions may be attached to the inner drum walls in a manner that permits for convenient removal and replacement in case of wear.

Providing an oleophilic coating to internal drum walls 15 of the drum of FIG. 1 generally has a similar effect as attaching oleophilic protrusions 16 and 16*a* to said internal walls 15 for the purpose of oil phase particle enlargement, but the protrusions 16 or 16*a* are more effective if enough are provided.

The slurry product 27 that drops through the apertures 24 of the screen 14 connected to the drum 10 contains enlarged bitumen particles and may be transferred directly to a separator to recover the bitumen. The apertures 24 of the screen 14 are preferably slightly smaller in size than the apertures of an oleophilic belt separator used to separate bitumen from the slurry and the screen 14 has to be relatively large in size to allow a high throughput of slurry through such a screen.

Figure 2:
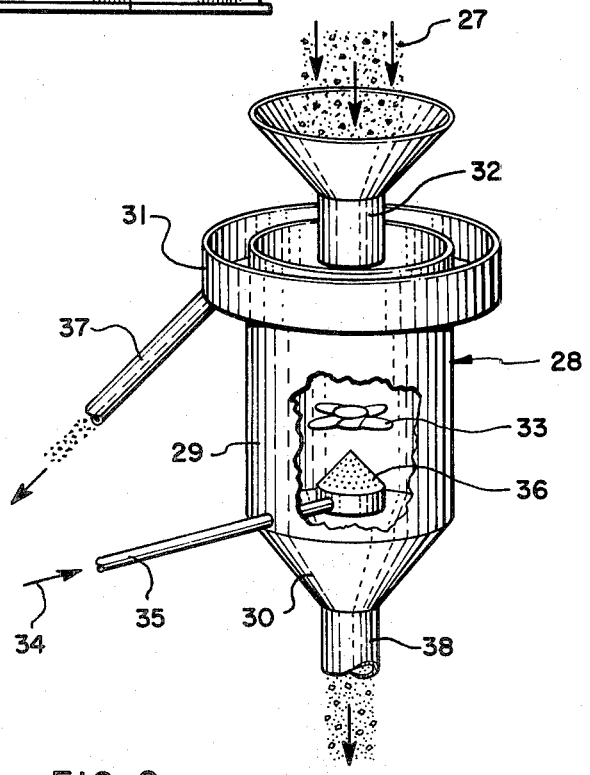
FIG. 2 is a perspective view of an apparatus for removing by elutriation coarse solids from a slurry before it is transferred to the oleophilic apertured belt separator.

In another embodiment of the invention the sand content of the slurry is reduced by elutriation prior to separation by an apertured oleophilic belt. Elutriation as illustrated in FIG. 2 consists of separating coarse solids from a slurry by dropping the slurry into a vessel 28 in which there is an upward flowing stream of water. The coarse solids fall downward through the vessel 28 while fine solids and bitumen or oil phase are carried over the top of the vessel. In this case the apertures 24 of the screen 14 may be larger than the apertures in the separation belt since the apparatus of FIG. 2 can accommodate larger solids than the belt. It is evident that when using an elutriation device the screen 14 does not have to be as large to allow a high throughput of slurry as when no elutriation apparatus is used. In some case a screen may not be required at all. The sand reduction or elutriation apparatus, illustrated in FIG. 2, consists of a vessel 28 that has a cylindrical body 29 and a conical bottom 30 with an annular collar 31 at the top. This vessel is full of water (not shown) that continuously overflows and spills into the collar 31. Slurry 27 from the screen 14 of the conditioning drum 10 enters the vessel 28 through an inlet channel 32 at a location some distance below the water level. A stirrer 33 or some other device creates a turbulence in the water and disperses the slurry. Water 34 flows through a pipe 35, through a distributor 36 into the vessel 28, in quantity sufficient, such that an upward flow through the cylindrical body into the annular collar 31 is created. Along with water, fine mineral particles and bitumen from slurry 27 are carried upward in the form of a slurry. This slurry is transferred to a belt separator through pipe 37 for subsequent recovery of bitumen. Compared with the slurry 27 entering the vessel 28 through the channel 32 the slurry that is leaving the collar 31 through the pipe 37 may be closer to the optimum temperature desired for the subsequent separation, it is more dilute and the solids have a smaller mean particle size. The pebbles, lumps and coarse sand from slurry 27 drop through the lower end 30 of vessel 28 and are discarded through a pipe by means of a mechanical device such as a slurry pump or a conveyor (not shown).

In the apparatus of FIG. 2 the slurry temperature is adjusted and the coarse solids and oversize mineral material are removed from the slurry. This is done so that the rate of subsequent slurry separation by the apertured oleophilic belt separation apparatus may be increased or so that smaller belt apertures may be used in said separation apparatus. The elutriation apparatus here described serves as an example only and is not intended to limit the invention in any way. Other means of sand reduction, removal of oversize material or cooling of the slurry will be apparent to those skilled in the art. Screening of the slurry after elutriation may be required to remove oversize materials prior to separation by the belt.

Thus, mined oil sand feed requires a slurry preparation step prior to separation by an apertured belt and that is provided by the present invention. In this preparation step oil sand is tumbled in a horizontal drum in the presence of steam, water and inwardly protruding oleophilic drum surfaces, to form a smooth aqueous slurry wherein the sand grains are disengaged from each other and from bitumen which forms into droplets and streamers. Oversize rocks, lumps of clay, debris and undigested oil sand are removed by appropriate means. Coarse sand and oversize material may be removed if desired by elutriation. Similarly, oil-phase reduced or solids reduced slurries may be tumbled in the drum of the present invention to disengage solids from oil phase particles and/or to increase the average oil phase particle size of these slurries. Oil-in-water emulsions may be tumbled in the drum of the present invention with or without addition of demulsifiers to increase their average oil phase particle size. Water-in-oil emulsions may be tumbled in the drum of the present invention with or without addition of demulsifiers to increase their average aqueous particle size. When the dispersed phase is aqueous at least a portion of the surfaces of the protrusions and the interior surface of the drum may be hydrophilic.

The desired viscosity of the phases of the mixture depends upon which is the continuous phase. When oil is the continuous phase of the mixture, the preferred viscosity of the oil phase is within the range 0.10 to 500 poises, with the most preferred range being 1.0 to 50 poises. When oil is the dispersed phase of the mixture, the preferred viscosity of the oil phase is such as to provide optimum "tackiness" to the oil phase particles and is within the range 1.0 to 5000 poises, as already mentioned, with the most preferred range being 10 to 500 poises. Generally, "tackiness" refers to the ability of oil particles to adhere to themselves and to oleophilic surfaces.

Reagents may be added to the mixture before it enters the drum or while it is in the drum, for the purpose of aiding in the process of the present invention, for breaking emulsions, for increasing the affinity of the dispersed phase for the surfaces of the free bodies, for increasing the affinity of the surfaces of the protrusions and inner drum surface for the dispersed phase, and/or for increasing the affinity of particulate solids in the mixture for one of the phases of the mixture. Addition of inorganic alkaline earth hydroxides or salts, such as for example, calcium sulphate or calcium hydroxide, is very effective for breaking tight oil sand oil-in-water emulsions. Non-ionic, water soluble-polyethylene oxide polymers having a molecular weight in the range of 10,000 to 7,000,000 added to the mixture may serve to aid the alkaline earth chemicals in breaking tight oil-in-water emulsions. The most effective temperature for adding such polymers to the mixture is when the mixture is in the range of 120° to 210° F. Depending upon the desired temperature for uniting of dispersed oil phase particles, this polymer addition may be made to the drum contents or it may be made to the feed prior to entering the drum. In this latter case, the feed may be cooled prior to entering the drum for the purpose of operating both the chemical treatment step and the dispersed particle size growth step at differing optimum temperatures. U.S. Pat. No. 4,058,453 issued on Nov. 15, 1977 to Mahendra S. Patel et. al. discloses the use of such a polymer mixture to break an oil-in-water emulsion. However, instead of using inwardly extending protrusions for that purpose, as disclosed in the present invention, Patel et. al. disclose the need for a hydrocarbon diluent to collect the dispersed phase, which is not required in the present invention.

The use of alkaline earth hydroxides or salts, however, may in some cases be a deterrent to effective production of slurries from mined oil sands and to their subsequent separation. The reason for this may be found in the observation that two opposing requirements are to be met when separating mined oil sands by the method of the present invention. First the bitumen is to be dislodged from between the sand grains and this is enhanced by providing operating conditions that encourage dispersion of the bitumen phase in the slurry. Then the bitumen particles are required to unite or coalesce so as to increase their size to facilitate subsequent separation of the bitumen from the slurry. The presence of alkali metal hydroxides, carbonates, silicates or mixtures thereof dissolved in the slurry encourage dispersion of the bitumen in the slurry but also encourage uniting of the dispersed bitumen to form larger particles. Addition of alkaline earth hydroxides or salt therefore are particularly advantageous for treating in the present invention emulsion and slurry feeds that already consist of finely dispersed oil phase.

Non-ionic surface active compounds, as for example a chemical demulsifier comprising polyethoxyalkene compound sold under the trade name of NALCO D-1645 produced by the Nalco Chemical Company, may be added to the feed or to the drum for the purpose of breaking a water-in-oil emulsion and of making it easier for hydrophilic surfaces of the protrusions and drum interior to enlarge dispersed water phase particles.

Another preferred demulsifier for adding to a water-in-oil emulsion in the present invention is sold under the trade name of BREAXIT 7941 and comprises a mixture of: (1) One part of the reaction product of diethyl ethanolamine with premixed propylene oxide and ethylene oxide; and (2) approximately three parts of a palmitic acid ester of the reaction product of an alkyl phenol formaldehyde resin with ethylene oxide. Other satisfactory demulsifiers that may aid in increasing the mean water particle size of a water-in-oil emulsion in the present invention are polyoxypropylene glycols produced by the Wyandotte Chemical Company under the tradename "Pluronic".

An enhanced transfer of particulate solids to the water phase of the mixture tumbling within the drum of the present invention may, in some mixtures, be effected by addition to these mixtures of hydrophilic surface active transfer agents, such as polyphosphates. Any water soluble salt of pyrophosphoric acid, $H_2P_2O_7$, such as for example tetrasodium pyrophosphate or sodium tripolyphosphate, are transfer agents and may be mixed with the feed or the drum contents in proportion of 0.01 percent to 1.0 percent to effect an improvement in the recovery of particulate solids in the water phase. Addition of sodium hydroxide with said polyphosphate reagent in about equal proportion may aid in effecting the improvement.

In instances where the oil phase of the mixture may contain heavy mineral; for example, bitumen may contain as high as 1 to 10 percent of heavy minerals as for example zircon, rutile, ilmenite, tourmaline, apatite, staurolite, garnet, etc; it may be desirable to employ chelating agents to make these particulate heavy minerals water wet and cause them to report to the water phase. Examples of suitable chelating agents are ethylenediamine-tetraacetic acid, sodium gluconate, gluconic acid, sodium oxalate and diethylene glycol. Chelating agents may be added to mixtures wherein oil is the continuous phase or they may be added to mixtures where water is the continuous phase. Generally they are the most effective when added to mixtures in which oil is the continuous phase.

The practice of the invention is exemplified by the following examples involving the equipment illustrated in FIGS. 1, 2, 3 and 4.

EXAMPLE 1

A steel conditioning drum is provided having a length of 3.0 feet and a diameter of 2.0 feet. The rear end of the drum contains a hopper for accepting oil sand and water that is joined to the drum by means of a pipe and a rotary seal that prevents spilling of drum contents from the rear end of the drum. The front end of the drum is provided with a central exit opening and with an 18 inch long, 18 inch diameter reinforced cylindrical mesh screen with 0.102 inch apertures, that encloses the exit opening. A steam pipe enters through the exit opening and terminates into a distributing valve that directs steam into 12 sparging pipes mounted parallel with the inside cylindrical drum wall and in spaced relationship along its periphery. The inside drum walls are made oleophobic. An oleophilic belt separator is mounted under the external mesh screen of the drum. As illustrated in FIG. 1, the drum is mounted on casters while a belt on the drum circumference attached to a motor driven pulley provides the power to rotate the drum at 10 r.p.m. One thousand pounds per hour of oil sand, consisting of 80.5 percent solids, 7.5 percent bitumen and 12.0 percent water is fed to the hopper of the drum for a period of five hours and is mixed therein with 100 pounds per hour of 60° F. water and 50 pounds per hour of 5 psi steam. The product slurry passing through the apertures of the external screen contains 6.4 percent bitumen, 24.4 percent water and 69.2 percent solids and has a temperature of 140° F. Seventy five pounds per hour of reject oversize material is conveyed away from the end of the cylindrical mesh screen. The product slurry passing through the apertures of the external screen feeds to a hopper of a neoprene coated nylon mesh apertured oleophilic belt separator where bitumen of the slurry is captured by the belt and solids and water pass through the belt apertures. The belt apertures measure 0.12 inch across the belt and 0.24 inch along the belt. The solids and water product passing through the apertures of the belt separator contains 1.5 percent bitumen and the remainder of the bitumen is captured by the belt.

EXAMPLE 2

The same apparatus of Example 1 is used in Example 2 except that the internal drum walls are covered with an oleophilic coating and twelve 6 inch high apertured baffles are mounted adjacent to the steam sparging tubes of the drum as illustrated in FIG. 4. The baffles are fabricated from wire 4 mesh steel material and are coated with neoprene, vulcanized and are mounted on angle iron supports welded to the drum inside cylindrical wall. One thousand pounds per hour of oil sand of the same grade as in Example 1 is fed to the hopper of the drum for a period of five hours and is mixed therein with 100 pounds per hour of 60° F. water and 50 pounds per hour of 5 psi steam. The product slurry passing through the apertures of the cylindrical mesh screen contains 6.0 percent bitumen, 23.5 percent water and 70.5 percent solids and has a temperature of 142° F. Seventy pounds per hour of reject oversize material is discarded from the cylindrical screen. The product slurry passing through the cylindrical screen feeds to a separation zone of the apertured oleophilic belt separator of Example 1. The solids and water product passing through the apertured belt separator contains 0.5 percent bitumen and the remainder of the bitumen is captured by the belt. The product slurry from this example visually contained larger bitumen particles and streamers than the product slurry from Example 1. Moreover, after passing through the oleophilic recovery belt, the oil depleted slurry from Example 1 contained roughly three times more bitumen than the oil depleted slurry from the example.

EXAMPLE 3

Sludge recovered from an effluent retaining pond of a hot water oil sand extraction plant containing 75.1 percent water, 22.0 percent mineral matter and 3.0 percent bitumen containing some light hydrocarbon diluent is used as a feed for the drum of FIG. 1. A sample of the feed is cooled to 33° F. and is observed. The volume of each particle in the sludge feed on the average is very much smaller than 1.0 microliter. Two hundred pounds of sludge per hour at a temperature of 50° F. are fed to the hopper of FIG. 1 for 4 hours. The same apparatus of Example 2 is used for conditioning the sludge. Seventeen pounds of 5 psi. steam per hour are added to the sludge via the sparging tubes of the drum. No oversize material remains on the external cylindrical screen. The product slurry passing through the cylindrical screen at the drum exit contains 76.9 percent water, 20.3 percent mineral and 2.8 percent bitumen. A sample of the slurry product is cooled to 33° F. and is visually inspected. At least 50 percent of the total bitumen volume in this product is in the form of droplets and streamers that individually are larger in volume than 1.0 microliter.

Although the invention as has been described is deemed to be that which forms the preferred embodiments thereof, it is recognized that departures may be made therefrom and still be within the scope of the invention which is not to be limited to the details disclosed but is to be accorded the full scope of the claims so as to include any and all equivalent methods and apparatus.

For example, the drum may be inclined instead of being perfectly horizontal without departing from the scope of the invention. Other similar modifications will also become apparent to those skilled in the art.

I claim:

1. A method for producing a slurry from mined oil sand consisting of a dispersed bitumen phase and a continuous aqueous phase and increasing the particles size of dispersed bitumen phase particles in said slurry which comprises the steps of (a) introducing an oil sand into a generally horizontal rotating drum having protrusions extending inwardly from the interior thereof wherein at least a portion of said interior and inwardly extending protrusions have oleophilic surfaces, (b) introducing concurrently with the oil sand a member selected from the group consisting of water, steam and combinations thereof into said rotating drum thereby forming an oil sand slurry containing dispersed bitumen particles (c) causing said slurry to come into contact with the inner surface and protrusions of said drum as it rotates such that dispersed bitumen particles adhere to the oleophilic portion of said surfaces and unite to form coatings thereon and which slough off back into said slurry in the form of larger dispersed bitumen phase particles, and (d) removing said slurry containing said larger bitumen particles from said drum for subsequent separation of bitumen phase from the continuous aqueous phase.

2. A method as in claim 1 wherein said inward protrusions consist of apertured baffles mounted longitudinally along the inside cylindrical drum wall of said drum.

3. A method as in claim 1 wherein a cylindrical apertured screen is used inside said drum to prevent contact of rocks and lumps of said slurry with said inward protrusions.

4. A method as in claim 1 wherein said slurry upon removal from said drum passes through a sieve external to said drum.

5. A method as in claim 1 wherein said slurry product removed from said drum is treated to remove oversize materials and coarse sand particles.

6. The method as in claim 1 wherein the surfaces of said inwardly extending protrusions are oleophilic.

7. The method as in claim 6 wherein the interior surface of said drum is also oleophilic.

8. A method as in claim 1 wherein the dispersed bitumen particles have a viscosity in the range of 1.0 to 5000 poises.

9. The method according to claim 1 wherein the drum rotates at a speed sufficient to cause contact of the bitumen particles in the slurry with the inner surface and inwardly extending protrusions of the drum but at a speed not in excess of $$\sqrt{\frac{2936}{r}} \text{ r.p.m.}$$

wherein r is the inner radius of the drum measured in feet.

10. A method according to claim 1 wherein a member selected from the group consisting of alkali metal hydroxides, carbonates and silicates and mixtures thereof is added to the mixture being treated in the drum to encourage dispersion of the bitumen phase and its disassociation from the sand grains.

11. The method according to claim 1 wherein oil sand, water and steam are continuously fed into said drum and treated product slurry is continuously removed from said drum.

12. A method for increasing the mean particle size of dispersed phase particles in an emulsion of continuous phase and dispersed phase which comprises the steps of:

(a) introducing said emulsion into a generally horizontal rotating drum having protrusions extending inwardly from the interior thereof wherein at least a portion of said interior and inwardly extending protrusions have surfaces which attract the dispersed phase particles, (b) causing said emulsion to come into contact with the interior and protrusion surfaces of said drum as it rotates such that dispersed phase particles adhere to the portion of said surfaces thereof to which they are attracted and unite to form coatings thereon which then slough off back into said emulsion in the form of larger dispersed phase particles, and (c) removing said emulsion containing said larger dispersed phase particles from said drum for subsequent separation of dispersed phase from continuous phase.

13. A method according to claim 12 wherein the dispersed phase is an oil phase and the continuous phase is an aqueous phase.

14. A method according to claim 13 wherein the surfaces of said inwardly extending protrusions are oleophilic.

15. A method according to claim 14 wherein the interior surface of said drum is also oleophilic.

16. A method according to claim 13 wherein emulsion is continuously fed into said drum and treated emulsion containing enlarged oil phase particles is continuously removed from said drum.

17. A method according to claim 13 wherein an emulsion breaking chemical is added to the emulsion during processing.

18. A method according to claim 12 wherein the dispersed phase is an aqueous phase and the continuous phase is an oil phase.

19. A method according to claim 18 wherein at least a portion of the surface of said inwardly extending protrusions are hydrophilic.

20. A method according to claim 19 wherein at least a portion of the internal surface of said drum is also hydrophilic.

21. A method according to claim 18 wherein emulsion is continuously fed into said drum and treated emulsion containing enlarged aqueous phase particles is continuously removed from said drum.

22. A method according to claim 18 wherein an emulsion breaking chemical is added to the emulsion during processing.

23. A method for increasing the mean particles size of dispersed phase oil particles in a slurry of aqueous continuous phase, dispersed oil phase and particulate solids which comprises the steps of:

(a) introducing said slurry into a generally horizontal rotating drum having protrusions extending inwardly from the interior thereof wherein at least a portion of said interior and inwardly extending protrusions having oleophilic surfaces (b) causing said slurry to come into contact with the interior and protrusion surfaces of said drum as it rotates such that dispersed oil phase particles adhere to the oleophilic portion of said surfaces and unite to form coatings thereon and which slough off back into said slurry in the form of larger dispersed oil phase particles, and (c) removing said slurry containing said larger oil phase particles from said drum for subsequent separation of oil phase from the continuous aqueous phase.

24. A method as in claim 23 wherein said inward protrusions consist of apertured baffles mounted longitudinally along the inside cylindrical drum wall of said drum.

25. A method as in claim 23 wherein said slurry is pretreated to remove oversize materials and coarse sand prior to being introduced into said rotating drum.

26. A method as in claim 23 wherein said slurry upon removal from said drum passes through a sieve external to said drum.

27. A method as in claim 23 wherein said slurry removed from said drum is treated to remove oversize materials and coarse sand particles.

28. The method as in claim 23 wherein the surfaces of said inwardly extending protrusions are oleophilic.

29. The method as in claim 28 wherein the interior surface of said drum is also oleophilic.

30. A method as in claim 23 wherein the dispersed oil phase particles have a viscosity in the range of 1.0 to 5000 poises.

31. The method according to claim 23 wherein said slurry is continuously fed into said drum and treated product slurry is continuously removed from said drum.

* * * * *